US005682680A

United States Patent [19]

Häussermann et al.

[11] Patent Number: 5,682,680

[45] Date of Patent: Nov. 4, 1997

[54] GUIDE BAR FOR A SAW CHAIN

[75] Inventors: Siegfried Häussermann, Asterweg; Jochen Buchholtz, Sperlingweg, both of Germany

[73] Assignee: Andreas Stihl, Waiblingen, Germany

[21] Appl. No.: 607,362

[22] Filed: Feb. 27, 1996

[30] Foreign Application Priority Data

Feb. 28, 1995 [DE] Germany ..... 195 06 827.0
Dec. 14, 1995 [DE] Germany ..... 195 46 627.6

[51] Int. Cl.[6] ..... B27B 17/02

[52] U.S. Cl. ..... 30/387; 30/383

[58] Field of Search ..... 30/383–387

[56] References Cited

U.S. PATENT DOCUMENTS 3,987,543 10/1976 Ratz et al. ..... 30/383
4,381,606 5/1983 Ekrud et al. ..... 30/387
4,498,493 2/1985 Tasumura ..... 30/387

FOREIGN PATENT DOCUMENTS 8302916 9/1983 WIPO .

*Primary Examiner*—Douglas D. Watts
*Attorney, Agent, or Firm*—Robert W. Becker & Associates

[57] ABSTRACT

A guide bar for a saw chain has a sort-shaped base member made of solid material, having a front end with a deflection area for a saw chain and a rear end for connecting the guide bar drive unit. The base member has outer lateral surface extending from the front end to the rear end and a longitudinal central axis extending from the front end to the rear end. The base member has a main body and a separate front member welded to the main body so as to have a welding seam on at least one of the lateral surfaces. The base member has an edge with a continues circumferential groove for receiving and guiding the saw chain.

23 Claims, 7 Drawing Sheets

GUIDE BAR FOR A SAW CHAIN

BACKGROUND OF THE INVENTION

The present invention relates to a guide bar for a saw chain comprised of a sword-shaped base member of solid material with a circumferential groove being machined into the edge of the guide bar for guiding the circulating saw chain whereby the forward end of the guide bar comprises a deflection area for the saw chain and whereby a rearward end is used for clamping the guide bar to a drive unit. At least a portion of the deflection area is a separate component that is fastened to the base member. Such guide bars of solid material are for example known from international application WO-83/02916. They are designed for use in motor chain saws or harvesters. Into the outer edge of the sword-shaped base member comprised of solid material a circumferential groove is machined which serves for guiding the circulating saw chain. The forward end of the guide bar comprises a deflection area in which a deflection sprocket wheel is arranged. For this purpose, the deflection area is broached such that a side plate remains or a slot of sufficient depth is provided between side plates by sawing or grinding for receiving the deflection sprocket wheel. Onto the broached side plate the deflection sprocket wheel, respectively, its bearing is fastened, preferably by riveting. The broaching of the deflection area can be carried our by cutting or grinding. In each case the broaching step preformed at the deflection area until only a side plate remains is very labor-intensive. During the working process dimensional errors, planar errors etc. are produced so that an unimpeded guiding of the saw chain within the guide groove at the deflection area is difficult to achieve. The mechanical stability within the head portion is limited to the thickness of the side plate which supports the deflection sprocket wheel, respectively, the deflection roller and thus receives all of the pulling forces acting on the saw chain.

Since the material for the guide bar is especially hardened material, the machining of the forward end of the guide bar can only be preformed properly with special tools. Due to the hardness of the material considerable machining times are required despite the use of special tools.

It is therefore an object of the present invention to improve a guide bar of the aforementioned kind such that a simple construction of the head portion of the guide bar is realized which requires only a minimal machining time but affords precise embodiment of high stiffness.

SUMMARY OF THE INVENTION

The guide bar for a saw chain according to present invention is primarily characterized by:

A sword-shaped base member made of solid material having a front end with a deflection area for a saw chain and a rear end for connecting the guide bar to a drive unit;

The base member having outer lateral surfaces extending from the front end to the rear end and having a longitudinal central axis extending from the front end to the rear end;

the base member comprised of a main body and a separate front member welded to the main body so as to have a welding seam on at least one of the lateral surfaces; and the base member having an edge with a continuous circumferential groove for receiving and guiding the saw chain.

Preferably, the separate front member has a base surface and the main body has an end face. The base surface abuts the end face and defines a parting line therebetween. The parting line is covered by the welding seam connecting the main body and the separate front member. The welding seam extends over substantially the entire length of the parting line.

Advantageously, the base surface and the end face extend perpendicular to the longitudinal central axis.

Expediently, the end face and the base surface, in a direction perpendicular to the longitudinal central axis, are arc-shaped.

Preferably, the end face in the area of the longitudinal central axis has at least one recess opening in a direction toward the base surface and the base surface has a projection matching and engaging the recess.

Preferably, the recess has an under cut extending in the direction of the longitudinal central axis.

In a preferred embodiment of the present invention, the end face has a plurality of recesses opening in a direction toward the base surface and the base surface has a plurality of projections matching and engaging the recesses such that the end face and the base surface have a wave-shaped contour.

Preferably, the recesses and the projections are arranged on a circular arc described about the center point of the separate front member.

Advantageously, the base surface is comprised of planar sections extending outwardly from the longitudinal central axis at an angle to one another.

The angle preferably opens toward the separate front member and is approximately 100°.

Advantageously, the welding seam is made by laser welding.

Preferably, the separate front member has a center point positioned on the longitudinal central axis, wherein the length of the separate front member in the direction of the longitudinal central axis is substantially identical to the height of the separate front member in the direction perpendicular to the longitudinal central axis, wherein the separate front member a symmetrical relative to the longitudinal central axis.

Advantageously, the separate front member is symmetrical relative to the longitudinal central axis.

In another embodiment of the present invention, the separate front member and the main body engage positive-lockingly perpendicularly to the longitudinal central axis and the plane of the base member defined by the lateral surfaces.

Preferably, the separate front member and the main body engage positive-lockingly in a direction of a longitudinal central axis.

The separate front member preferably comprises the entire deflection area.

Preferably, the separate front member is comprised of at least one side plate having an outer plate surface forming part of the outer lateral surface.

Preferably, the guide bar comprises two of the side plates extending parallel to one another.

The side plates have a common base connecting the sides plates at one side thereof to a u-shaped structure.

In yet another embodiment of the present invention the side plates comprise an overlapped portion overlapping the edge of the end face of the main body in a direction of the longitudinal central axis. The overlapped portion has an edge projecting from the lateral surface and the welding seam is positioned along the edge on the outer lateral surfaces.

Advantageously, the separate front member has a base surface and the main body has an end face, wherein the base surface abuts the end face and defines a parting line therebetween. The guide bar further comprises a strip placed onto the parting line between the side plates and the main body for covering the parting line. The flat strip is welded onto the outer lateral surfaces such that the welding seam extends on the outer surfaces on the main body and on the outer plate surfaces of the side plates.

Preferably, the end face has a central stay projecting into a space between the side plates wherein the side plates are welded to the central stay.

Preferably, the central stay extends along the length of the end face from a bottom of the circumferential groove on one longitudinal side of the guide bar to the bottom of the side circumferential groove on the opposite longitudinal side of the guide bar.

Preferably, the guide bar further comprises a deflection sprocket wheel for the saw chain, the sprocket wheel rotatably supported at the separate front member.

Advantageously, the separate front member is comprised of a harder material than the main body.

According to the present invention, the front end or head portion of a standard guide bar is thus cut off, preferably with a laser, and a separate front member forming the deflection area, is welded to the end face of the main body preferably by laser welding. Unexpectedly, it has been found that a separate front member welded to the main body in order to form the head portion of the guide bar and to function as the deflection area comprises a greater stiffness than has been achievable in the past. This is probably caused by having the welding seam extend over considerable length of the parting line so that it acts at least partially into the depth of the parting line (i.e., between the end face and the base surface) and provides a connection in this area. It is furthermore surprising that a thermal deformation due to the laser welding process has not been detected so that the circumferential groove machined into the main body continues without interruption into the separate front member. The groove provided within the separate front member thus ensures a precise, unimpeded guiding of the saw chain within the deflection area.

The separate front member for connecting it to the main body comprises a base surface which preferably abuts bluntly the end face of the main body. The welding seam covers the parting line and is arranged on the outer lateral surfaces of the guide bar.

Preferably, the separate front member is of a symmetrical design relative to the longitudinal central axis of the guide bar, especially relative to the longitudinal central plane of the guide bar.

BRIEF DESCRIPTION OF THE DRAWINGS

The object and advantage of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 20.

Figure 1:
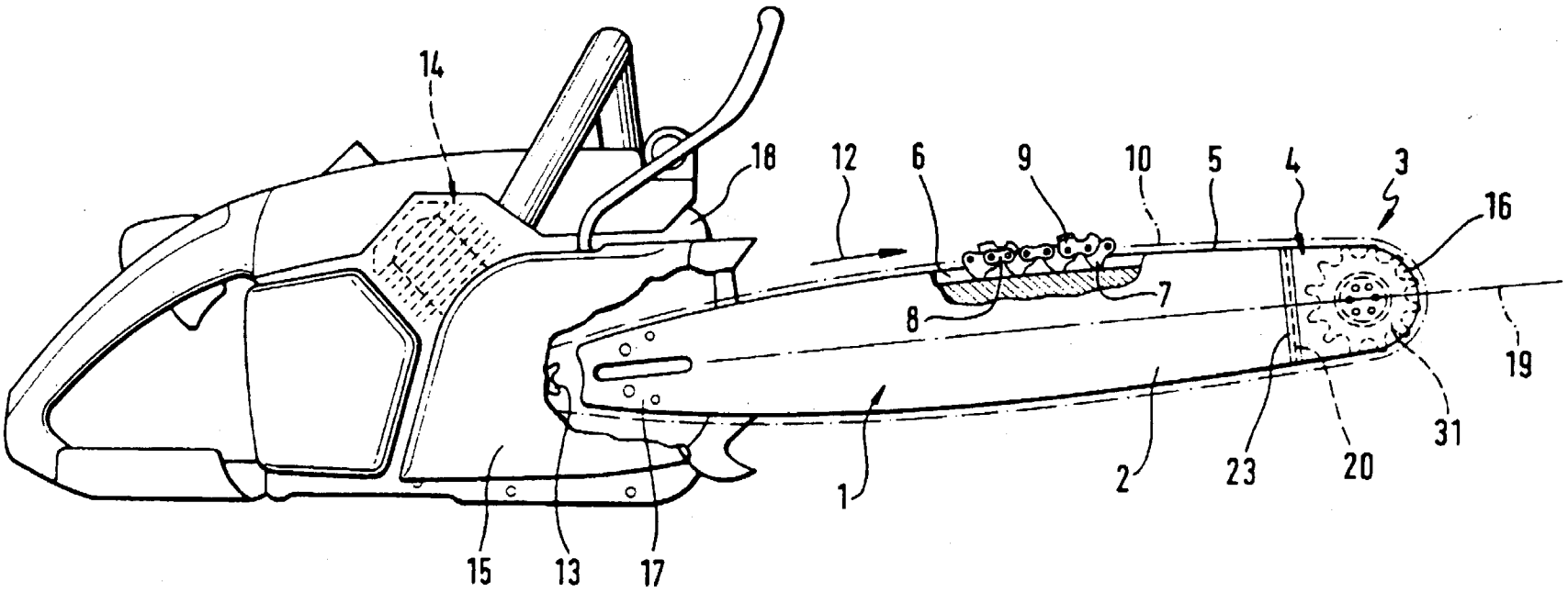
FIG. 1 shows a side view of a motor chain saw with inventive guide bar.

In the representation of FIG. 1 the first embodiment of a guide bar 1 is illustrated. It has a deflection area 3 which is embodied by a front member 4 that is separate from the main body 2. The main body 2 is comprised of solid material into which has been machined at the circumferential edge 5 a continuous outwardly open circumferential guide groove 6. The guide groove is engaged by projections 7 of the drive members of a saw chain 10 whereby the drive members are connected via laterally arranged connecting members 8 and cutting members 9 to one another. The connecting members 8 and the cutting members 9 are guided on guide surfaces 11 which are formed on end faces of stays which delimit the guide groove 6. In the deflection area 3 the saw chain 10 is guided by a deflection sprocket wheel 31 which is rotatably supported in a bearing 60. The saw chain 10 is driven in the direction of arrow 12 by a chain wheel 13 which is driven by drive motor 14 (in the embodiment shown an internal combustion engine).

In the embodiment of a motor chain saw, the chain wheel 13 is positioned under a chain wheel cover 15 whereby the rear end 17 of the guide bar 1 opposite the forward head portion 16 is clamped between the motor housing 18 and the chain wheel cover 15 perpendicular to the planar outer lateral surfaces of the guide bar 1. The guide bar 1 is thus fixedly attached to the housing 18 of the motor chain saw.

When used in connection with a harvester, the rearward end 17 is fastened with a clamping plate.

Figure 2:
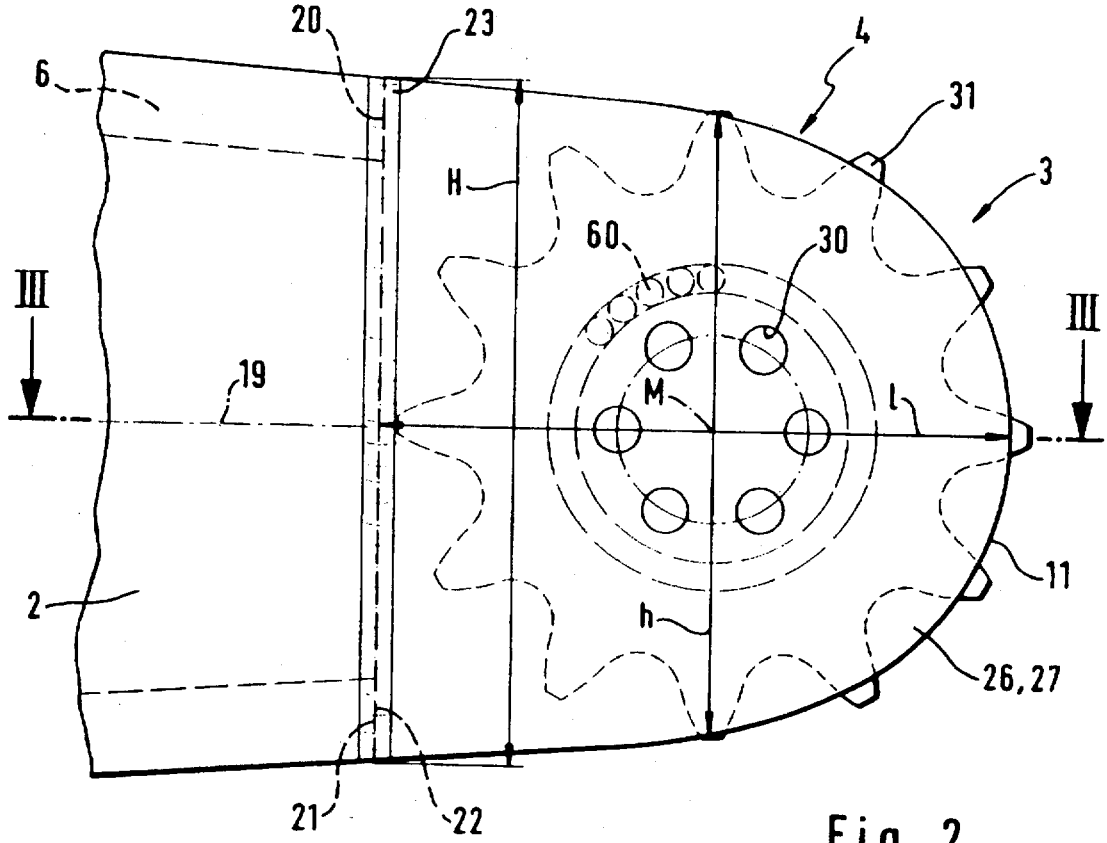
FIG. 2 shows a side view of the head portion of a guide bar.
Figure 3:
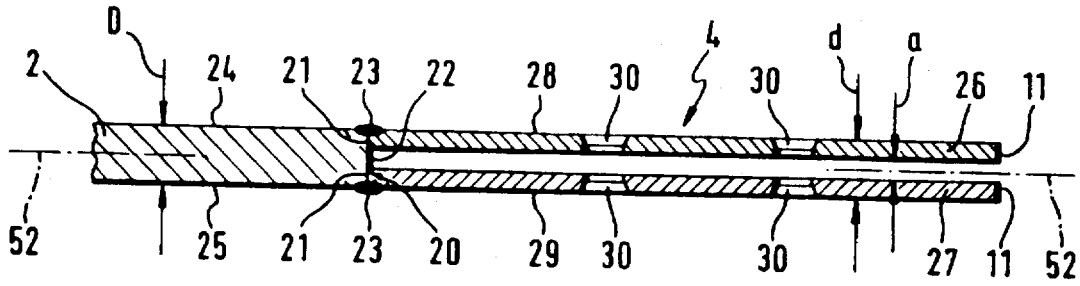
FIG. 3 shows a section along line III—III of FIG. 2.

As represented in detail in FIGS. 2 and 3, the deflection area 3 is in the form of a front member 4 separate from the main body 2 of the guide bar. The separate front member 4 is fastened to the main body 2. The separate front member 4 may be comprised of a different material that the main body. Preferably, the separate front member 4 is comprised of a harder material than the main body. The original front end of the main body 2 has been cut off by laser or any other tool thus providing an end face 22. The separate front member 4 thus abut flush with its base surface 21 at the facing end face 22 of the main body 2. The base surface 21 and the end face 22 are preferably embodied so as to match one another, in the manner of a negative and a positive pattern or mold. The surfaces of the end face 22 and the base surface 21 thus rest without play on one another and define an parting line 20 between the main body 2 and the separate front member 4 that defines the deflection area 3. Preferably, the separate front member 4 abuts bluntly with its base surface 21 the end face of the base body 2. The separate front member 4 and the base body 2 are especially welded to one another by laser from the outer lateral surfaces 24, 25 of the base body 2 along the parting line 20. The resulting welding seam 23 is thus positioned on the lateral surfaces 24, 25 and covers the parting line 20. As indicated in FIG. 2, the welding seam 23 extends over the entire height H of the parting line 20 which extends over the entire height of the end face 22 of the main body 2, respectively, the base surface 21 of the separate front member 4.

In the shown embodiment according to FIGS. 1 and 3, the separate front member 4 is comprised of side plates 26, 27 positioned relative to one another at a distance a whereby the arrangement is such that the outer plate surfaces 28, 29 facing away from one another are positioned in a common plane with the respective outer lateral surfaces 24, 25 of the guide bar 1. The separate front member 4 thus has a thickness d which corresponds to the thickness D of the main body 2.

As represented in FIG. 2, the separate front member 4, respectively, each side plate 26, 27 has a center point M which is positioned on the longitudinal central axis 19 of the main body 2. The length measured along the longitudinal central axis 19 of the separate front member 4 corresponds approximately to the height h measured at a right angle thereto at the center point M. The separate front member 4 is symmetrically designed relative to the longitudinal central axis 19 whereby the base surface 21 as well as the end face 22 each for a plane. In the shown embodiment of FIGS. 2 and 3, the base surface 21 as well as the end face 22 of the main body 2 are positioned at a right angle to the longitudinal center plane 52 of the guide bar 1. Preferably, the separate front member 4 is also symmetrically embodied relative to the longitudinal center plane 52. In this context, it should also be noted that the welding seams 23 are preferably also symmetrically arranged relative to the longitudinal central plane 52, respectively, the longitudinal central axis 19.

In the embodiment according to FIGS. 2 and 3 the entire deflection area 3 is formed by the separate front member 4. In the side plates 26 and 27 of the separate front member 4, rivet openings 30 are arranged opposite one another in pairs whereby, as shown in FIG. 2, six such rivet openings 30 are positioned on one side plate 26, respectively, 27 equidistantly relative to one another on a common circle. Between the side plates 26 and 27 a deflection sprocket wheel 31 is arranged so as to be rotatable within a bearing 60 whereby the teeth of the sprocket wheel slightly project past the outer guide surfaces 11 of the side plates 26 and 27. Preferably, the length l of the side plates 26 and 27 correspond approximately to the diameter of the deflection sprocket wheel 31.

The guide groove 6 embodied within the main body 2 extends into the separate front member 4. The side plates 26 and 27 of the separate front member 4 have a distance a which corresponds to the width of the circumferential guide groove 6. The attachment of the side plates to the main body as well as the fixation by welding, especially laser welding, ensures a precise connection to the main body 2 so that a precise guiding of the saw chain within the deflection area is afforded.

The embodiments represented in further FIG. 4 through 19 correspond in their basic construction to the embodiments of FIGS. 1 to 3. In the following only the differences between the embodiment of FIGS. 1 to 3 with respect to the newly presented ones will discussed.

Figure 4:
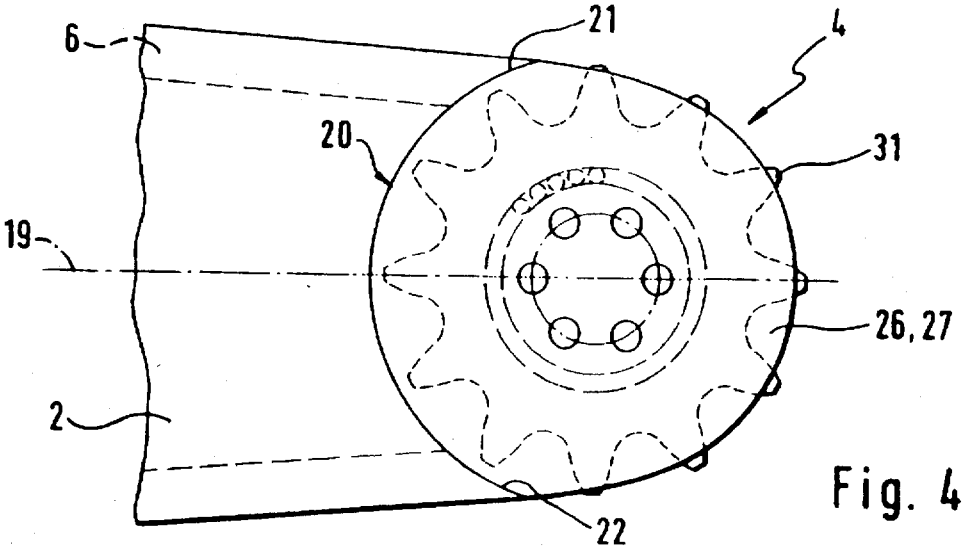
FIG. 4 shows a side view of the head portion of a guide bar with part-circular parting line.

In the embodiment according to FIG. 4 the parting line 20 is part-circular, especially halfmoon-shaped. The end face 22, which in a side view is halfmoon-shaped, thus engages the separate front member 4 over a portion of its circumference. The base surface 21 of the separate front member 4 which faces the end face 22 rests substantially without play at the end face 22. The side plates 26, 27 are substantially disc shaped and serve especially as cover plates for the deflection sprocket wheel 31 positioned between the side plates. The symmetrical design of the separate front member 4 relative to the longitudinal central axis 19 and the longitudinal central plane 52 ensures a simple arrangement at the forward end of the main body 2 whereby in the plane of the guide bar transverse to the longitudinal center axis 19 a positive locking action is achieved.

Figure 5:
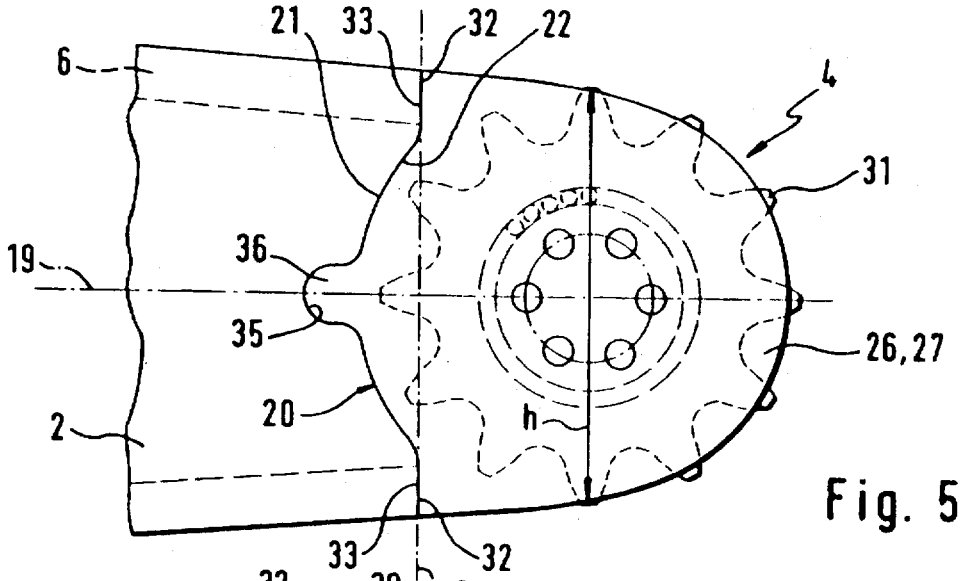
FIG. 5 shows a side view of the head portion of a guide bar with the separate front member having a projection extending axially and engaging the main body.

In the embodiment according to FIG. 5 the parting line 20 is partially straight, partially arc-shaped. The edges 32 of guide groove 6 facing the separate front member 4 as well as the correspondingly embodied end section of the base surface 21 are positioned in a plane 34 which extends at a right angle to the longitudinal central axis 19.

The arc-shaped portion of the parting line 20 positioned between the edges 32 is provided in the area of the longitudinal central axis 19 with a recess 35 which is positioned symmetrically to the longitudinal central axis 19 and which opens toward the separate front member 4. The recess 35 has a bottom portion of a semi-circular shape. This recess 35 is engaged by a projection 36 of the separate front member 4, respectively, of the side plates 26 and 27 forming the separate front member 4. The projection 36 exactly matches the shape of the recess 35. Accordingly, in a similar manner as in the embodiment according to FIG. 4, a positive-locking action of the separate front member 4, respectively, of the side plates 26, 27 in the direction of the longitudinal axis 19 is achieved with the main body 2.

Due to the projection 36 the side plates 26, 27 are somewhat longer at the level of the longitudinal central axis 19 as their height h.

Figure 6:
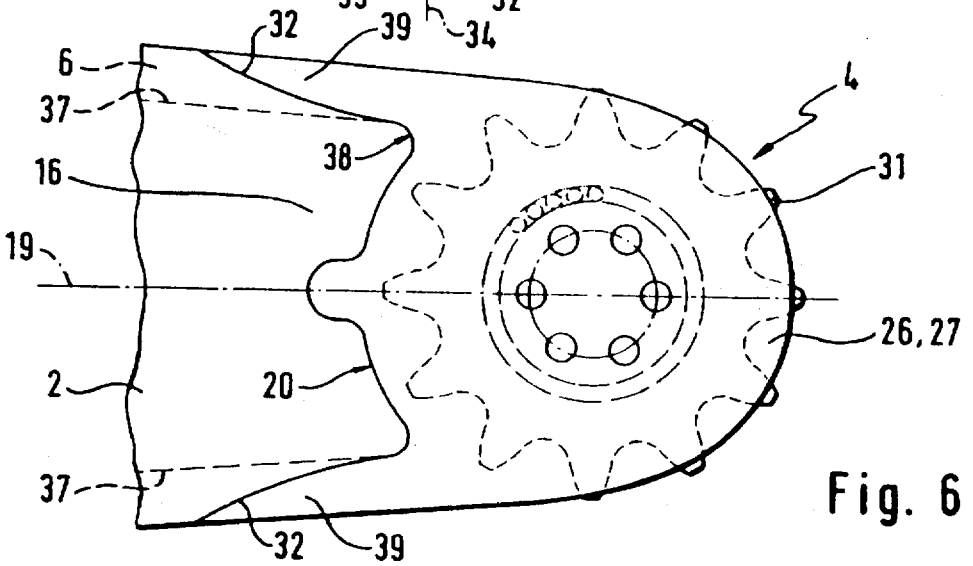
FIG. 6 shows a side view of a further embodiment of the head portion of the guide bar.

In the embodiment according to FIG. 6 the edges 32 of the guide groove 6 in the direction towards the rearward end 17 of the guide bar 1 (FIG. 1) are at a slant. Preferably, the edges 32, relative to the groove bottom 37, are concavely curved, whereby the transition into the part-circular, respectively, half moon-shaped middle section of the parting line 20 is achieved with a curvature 38 that approximately corresponds to a semi-circle.

The edges 32 which are slanted toward the rear end 17 of the guide bar 1 result in the arrangement of tapered corner flanges 39 at the side plates 26, 27 of the separate front member 4. The corner flanges 39 thus engage the forward end 16 of the main body 2 so that in the plane of the guide bar transverse to the longitudinal central axis 19 a positive-locking connection is achieved.

Figure 9:
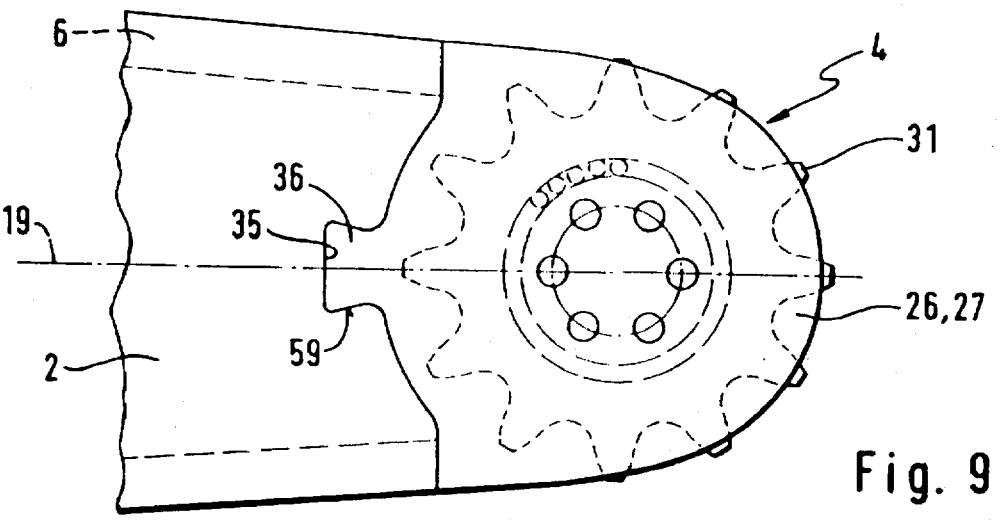
FIG. 9 shows a side view of the head portion of a guide bar in an embodiment corresponding to FIG. 5 with an axial undercut at the recess.

In order to achieve also a positive-locking engagement also in the axial direction of the side plates 26 and 27, respectively, of the separate front member 4, the recess 35 can be embodied such that it widens transverse to the longitudinal central axis 19 as shown in FIG. 9. The projection 36 at the separate front member 4 respectively, its side plates 26 and 27 thus widen in the direction towards their free end so that a dove-tail fit is provided. Such a separate front member 4 is thus laterally inserted into the recess 35 having a corresponding under cut 59 whereby with the projection 36, on the one hand, a positive-locking engagement transverse to the longitudinal central axis is 19 ensured and furthermore, an axial positive-locking engagement in the direction of the longitudinal central axis 19 is provided.

Figure 7:
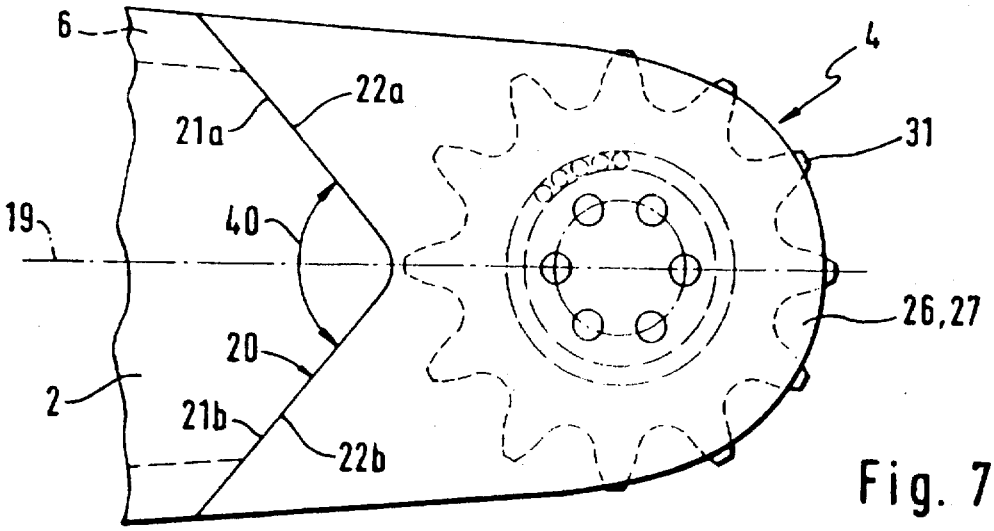
FIG. 7 shows a side view of the head portion of a guide bar with a dove-tail parting line.

In the embodiment according to FIG. 7 the base surface 21 of the separate front member 4 has preferably two planar sections 21*a* and 21*b* which extend from the longitudinal central axis 19 so as to form an angle 40 of preferably 100° between them. The angle 40 opens toward the main body 2 of the guide bar 1. The facing end face 22 of the main body 2 is also divided into corresponding sections 22*a* and 22*b*. The angle 40 is at its bottom rounded in order to ensure a simple machining. Such a design provides for a great length of the parting line 20 which is greater than the height of the guide bar in the area of the parting line 20. Thus, an especially long welding seam and, accordingly, a high stiffness in ensured.

Figure 8:
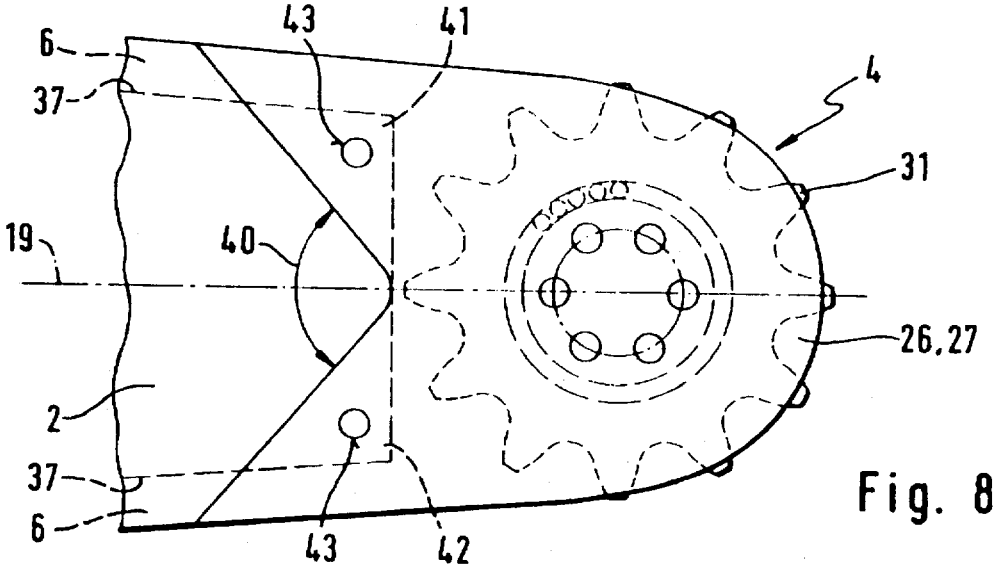
FIG. 8 shows a side view of an embodiment according to FIG. 7 with a central stay engaging the separate front member forming the deflection area.

The embodiment according to FIG. 8 corresponds substantially to the one of FIG. 7. On the sections 22*a* and 22*b* of the end face 22 of the main body 2 central stays 41, 42 are provided which have a substantially triangular shape, as can be seen in the side view of FIG. 8. The central stays 41 and 42 do not project in the direction of the longitudinal central axis 19 past the bottom, of the angle 40 and end transverse to the longitudinal central axis 19 at the level of the bottom 37 of the circumferential groove 6. The central stays 41,42 engage between the plates 26 and 27 as schematically represented in the section view of FIG. 19. In the area of overlap of the central stays 41 and 42 with the side plates 26 and 27 rivet openings 43 are provided in order to rivet the separate front member 4 additionally at the main body 2. At these locations the side plates 26, 27 can also be fastened by spot-welding on the central stays 41, 42.

The sections 21*a*, 21*b* respectively, 22*a*, 22*b* which are positioned at an angle of approximately 100° relative to one another provide for a positive locking engagement in the plane of the main body 2 transverse to the longitudinal central axis 19. The central stays 41 and 42 which engage between the side plates 26 and 27 of the separate front member 4 ensure also a positive-locking connection perpendicular to the plane of the main body 2. The rivets positioned within the rivet openings 43 provide for a positive-locking action in the direction of the longitudinal central axis 19.

Figure 10:
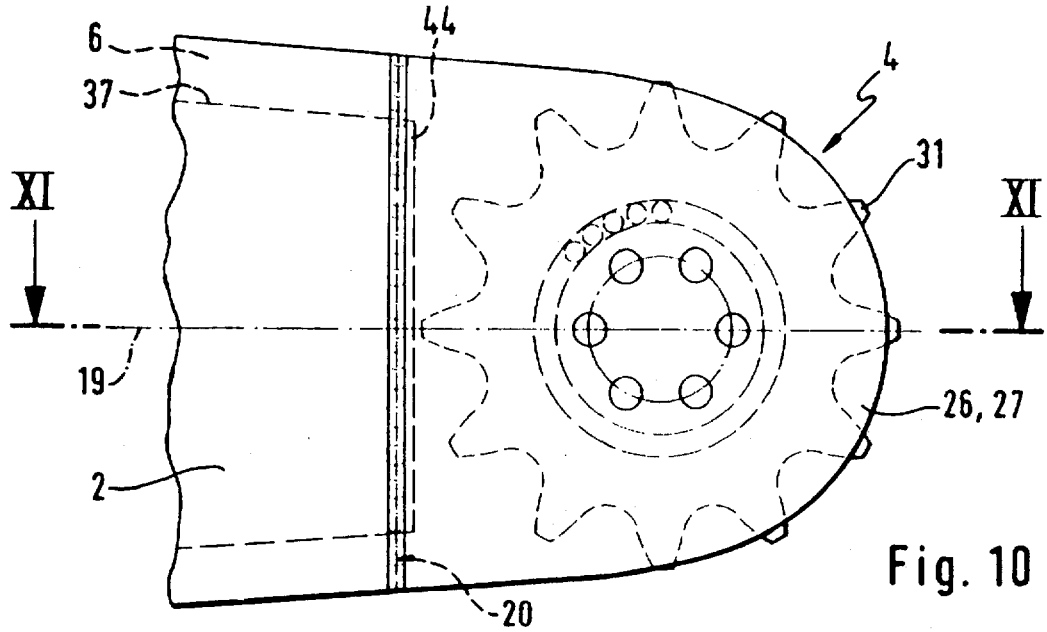
FIG. 10 shows a side view of the head portion of the guide bar in an embodiment according to FIG. 2 with side plates that are connected to form a U-shaped structure.
Figure 11:
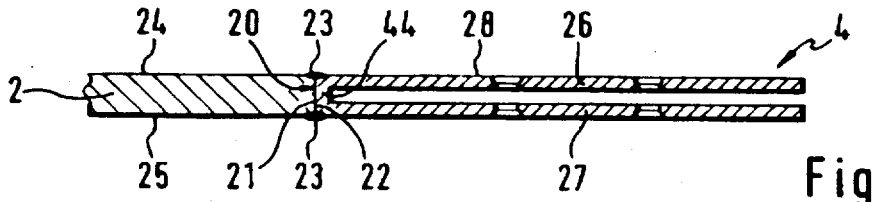
FIG. 11 shows a section along the line XI—XI in FIG. 10.

In yet another embodiment according to FIG. 10 and 11 the two side plates 26 and 27 are connected by a base 44 so that a u-shaped unitary front member 4 is formed. The base 44 extends from the bottom 37 of the circumferential groove at one longitudinal side to the bottom 37 at the opposite longitudinal side of the main body 2. The base surface 21 of the separate front member 4 corresponds thus in its size substantially identically to the end face 22 of the main body 2. By arranging a welding seam 23 so as to cover the parting line 20, the unitary front member 4 is thus securely and fixedly connected to the main body 2. The welding seam 23 is preferably laser-welded on one outer lateral surface 24 of the main body 2. The other outer lateral surface 25 is preferably also provided with a welding seam.

Figure 12:
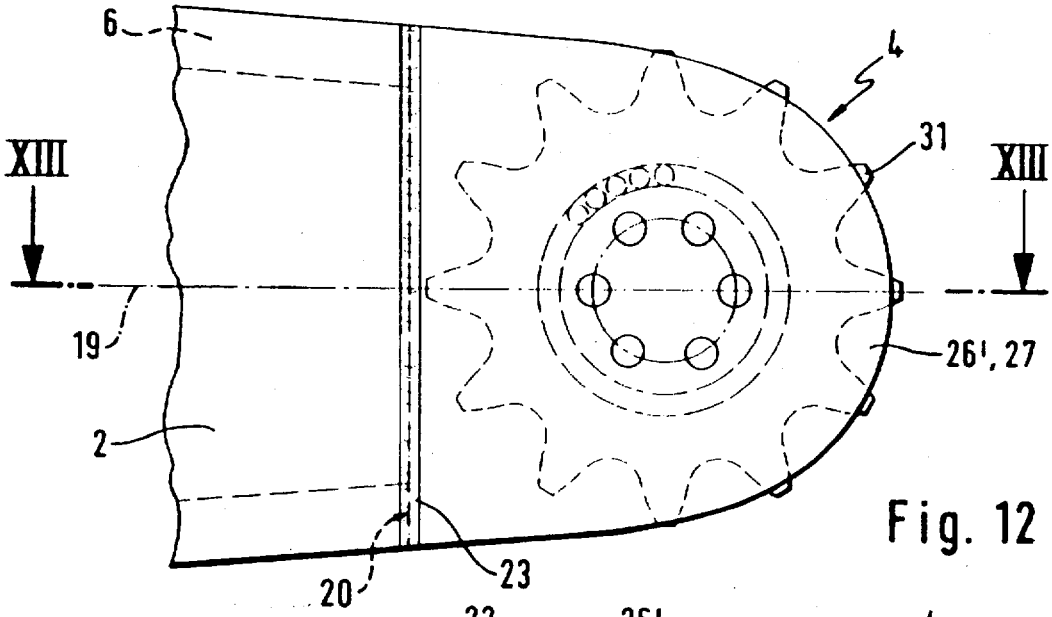
FIG. 12 shows a side view of the head portion of a guide bar with a separate front member comprised of a single side plate.
Figure 13:
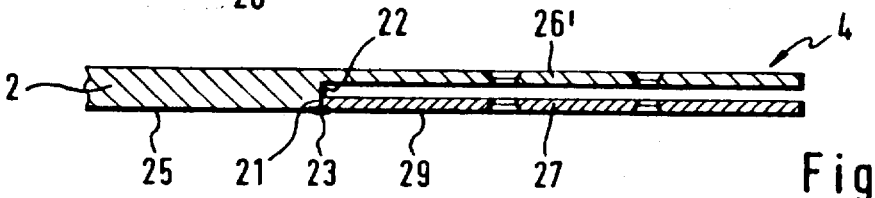
FIG. 13 shows a section along line XIII—XIII of FIG. 12.

As a variation of the disclosed embodiments of FIGS. 1 through 11, the separate front member 4 can also be comprised of a single side plate 27 as is represented in FIGS. 12 and 13. The plate 26 parallel to the side plate 27 is a unitary part of the main body 2. The welding seam 23 is thus only arranged on the outer lateral surface 25, respectively, the plate surface 29 and covers the parting line 20 between the base surface 21 of the side plate 27 and the abutting end face 22 of the main body 2.

Figure 14:
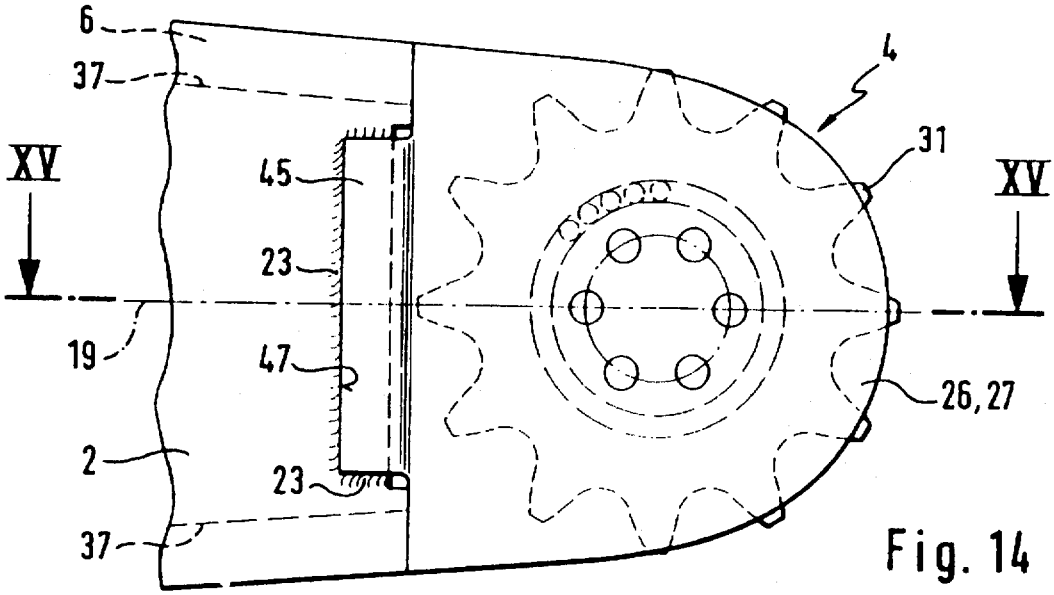
FIG. 14 shows a side view of the head portion of a guide bar with side plates over lapping the edge of the end face of the main body.
Figure 15:
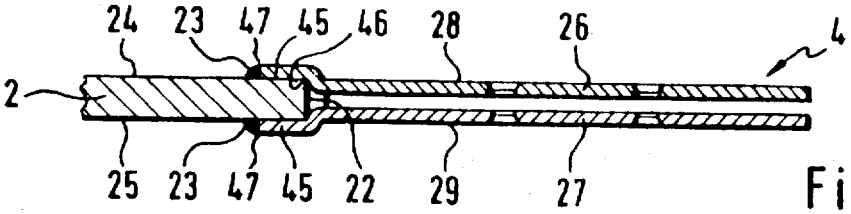
FIG. 15 shows a section along the line XV—XV of FIG. 14.

In the embodiment according to FIGS. 14 and 15 at the base surface 21 of each side plate 26, 27 an overlap portion 45 is provided which is a unitary part of the respective side plate 26, 27. The overlap portion 45 is bent outwardly so as to extend parallel to the plane of the side plates 26, 27 and is positioned on the lateral surfaces 24, 25 of the main body 2. The plate surfaces 28 and 29 are positioned, as disclosed in the previous embodiments, in the same plane as the lateral surfaces 24, 25. The overlap portion 45 extends between the opposite bottoms 37 of the guide groove 6 and is preferably shorter than the distance between the oppositely positioned bottoms 37.

The respective overlapped portions 45 overlapped the edge 46 of the end face 22 whereby the welding seam 23 is positioned in the corner between the lateral surfaces 24, 25 of the main body 2 and the edge 47 of the overlapped portion 45.

Figure 16:
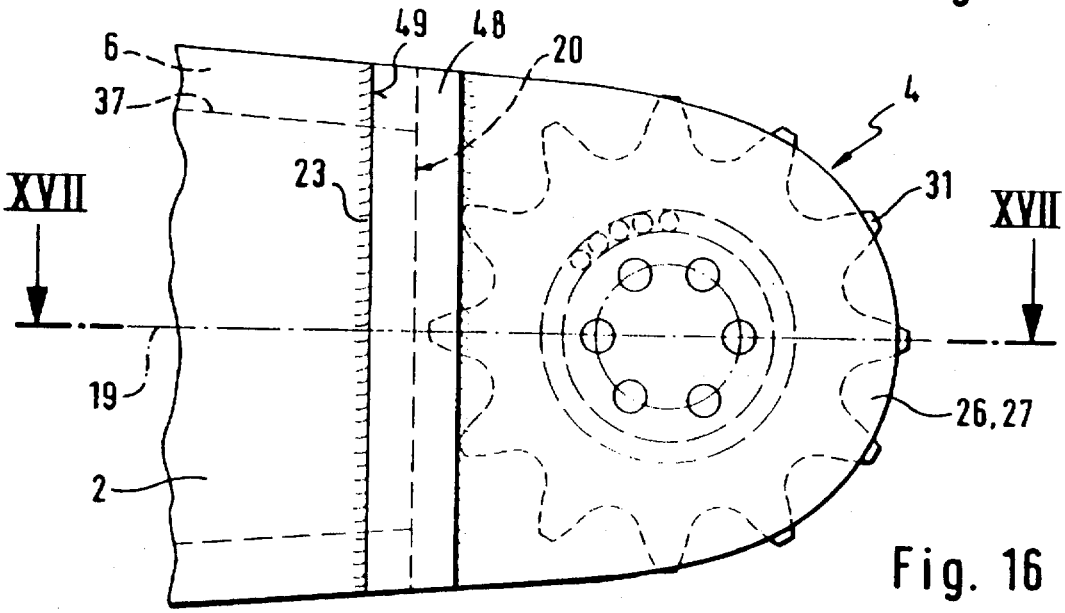
FIG. 16 shows a side view of the head portion of a guide bar in an embodiment according to FIG. 2 with flat strips covering the parting line.
Figure 17:
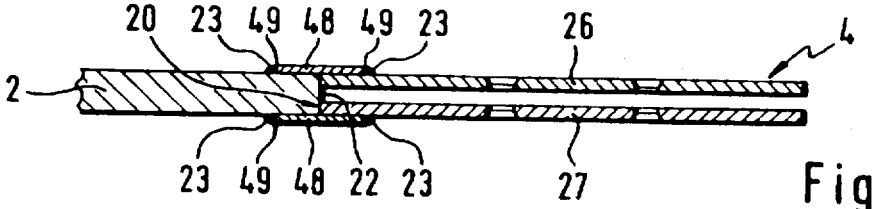
FIG. 17 shows a section along the line XVII—XVII of FIG. 16.

In the embodiment according to FIGS. 16 and 17 the side plates 26 and 27 of the separate front member 4, corresponding to the embodiment of FIGS. 2 and 3, abut bluntly the end face 22 of base body 2. The parting line 20 is covered by a flat strip 48 which at both longitudinal edges 49 is connected with a welding seam 23 to the main body 2 and the respective side plates 26, 27 of the separate front member 4. The flat strip 48 extends over the entire length of the parting line 20 and thus over the entire height of the main body 2.

Figure 18:
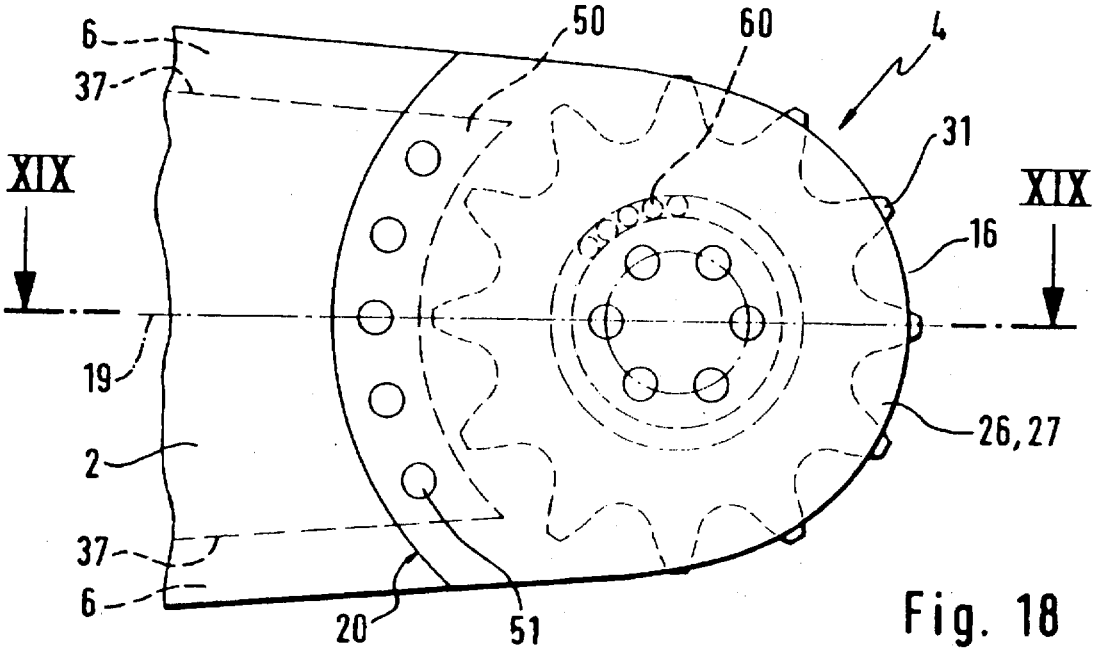
FIG. 18 shows a side view of the head portion of a guide bar in an embodiment according to FIG. 4 with a central stay and side plates spot-welded onto the central stay.
Figure 19:
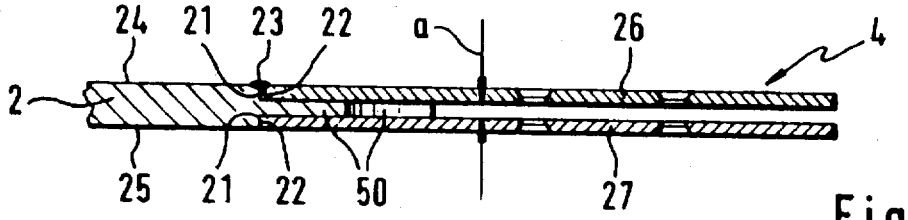
FIG. 19 shows a section along the line XIX—XIX of FIG. 18.

The embodiment according to FIGS. 18 and 19 corresponds in its basic design to the one of FIG. 4. The variation lies in that the end face 22 of the main body 2 comprises a central stay 50 which engages between the side plate 26 and 27 of the separate front member 4. The central stay 50 has a thickness corresponding to the distance of the side plates 26, 27 and in a side view has a part-annular shape. The center stay 50 extends from the upper bottom 37 through the lower bottom 37 of the continuous circumferential groove 6. It may be expedient to embody the central stay 50 shorter than the distance between the bottoms 37.

Instead of or in addition to the welding seam 23 each side plate 26, 27 is fastened by spot-welding to the central stay 50. In the shown embodiment the spot welds 51 are symmetrical to the longitudinal central axis 19 and are positioned approximately equidistantly relative to one another.

Figure 20:
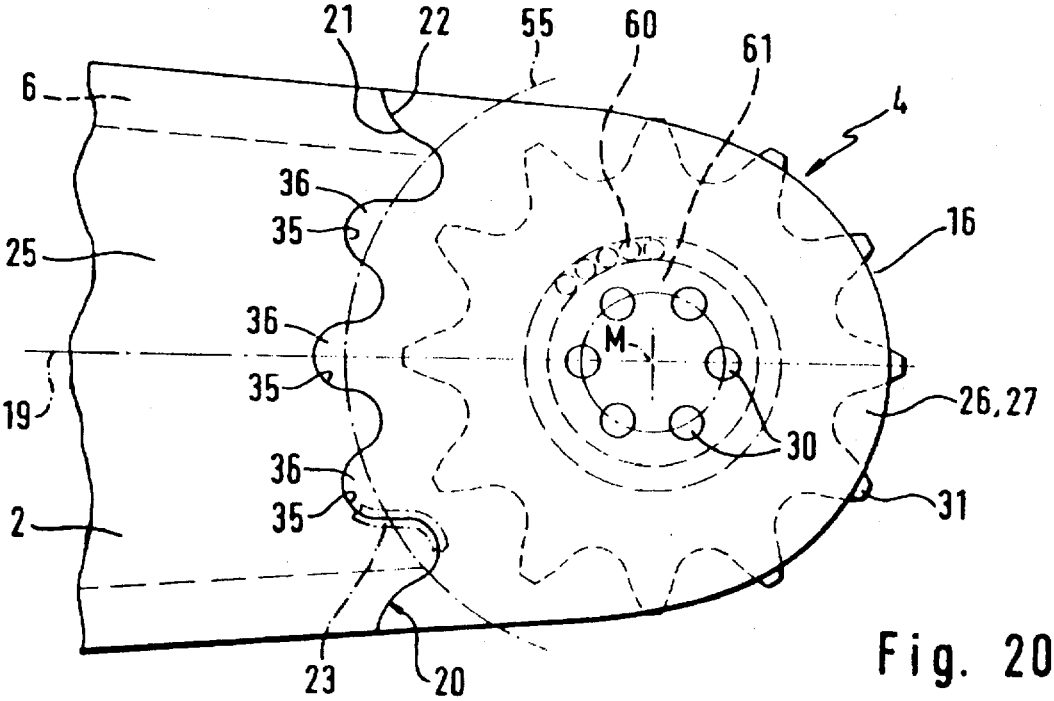
FIG. 20 shows a side view of the head portion of a guide bar in a further embodiment.

In the embodiment according to FIG. 20 the parting line 20 is wave-shaped. The end face 22 of the main body 2 has a plurality of recesses 35 positioned at a distance to one another which have matching projections 36 at the base surface 21 of the separate front member 4. The main body 2 and the separate front member 4 engage thus in a manner of a wave-shape comb (tooth-like) so that a positive-locking action transverse to the longitudinal central axis 19 of the main body 2 results. The recesses 35 and the projections 36 are positioned on a circular arc 55 about the center point M of the separate front member 4. The welding seam applied to the outer lateral surfaces 24, 25 of the main body 2 covers the parting line 20 and connects the side plates 26, 27 in the correct position and without deformation to the main body 2. The welding seam 23 extends substantially over the entire length of the parting line 20 on both sides of the main body 2. The deflection sprocket wheel 31 is secured with a bearing 60 on a hub 61 which is connected with rivets extending through the rivet openings 30 fixedly and positive-lockingly to the side plates 26, and 27 of the separate front member 4. The roller bodies of the bearing 60 roll on the hub 61 and the inner circumference of the deflection sprocket wheel 31. In the embodiments according to FIGS. 1 through 20 a roller bearing 60 is shown. However, it is also possible to use a sleeve bearing friction bearing, or similar bearing means:

The present invention is, of course, in no way restricted to the specific disclosure of the specification and drawings, but also encompasses any modifications within the scope of the appended claims.

What we claim is:

1. A guide bar for a saw chain, said guide bar comprised of:

a sword-shaped base member made of solid material and having a front end with a deflection area for a saw chain and a rear end for connecting said guide bar to a drive unit;

said base member having outer lateral surfaces extending from said front end to said rear end and having a longitudinal central axis extending from said front end to said rear end;

said base member comprised of a main body and a separate front member welded to said main body so as to have welding seams on both of said lateral surfaces;

said base member having an edge with a continuous circumferential groove for receiving and guiding the saw chain;

said separate front member having a base surface extending at a right angle continuously from one of said lateral surfaces to the other and said main body having an end face extending at a right angle continuously from one of said lateral surfaces to the other;

said base surface abutting said end face and defining a parting line therebetween;

said parting line covered by said welding seams connecting said main body and said separate front member; and said welding seams extending over substantially the entire length of said parting line.

2. A guide bar according to claim 1, wherein said end face and said base surface, in a direction perpendicular to said longitudinal central axis, are arc-shaped.

3. A guide bar according to claim 1, wherein said end face in the area of said longitudinal central axis has a least one recess opening in a direction toward said base surface and wherein said base surface has a projection matching and engaging said recess.

4. A guide bar according to claim 3, wherein said recess has an undercut extending in a direction of said longitudinal central axis.

5. A guide bar according to claim 1, wherein said end face has a plurality of recesses opening in a direction toward said base surface and wherein said base surface has a plurality of projections matching and engaging said recesses such that said end face and said base surface have a wave-shaped contour.

6. A guide bar for a saw chain, said guide bar comprised of:

a sword-shaped base member made of solid material and having a front end with a deflection area for a saw chain and a rear end for connecting said guide bar to a drive unit;

said base member having outer lateral surfaces extending from said front end to said rear end and having a longitudinal central axis extending from said front end to said rear end;

said base member comprised of a main body and a separate front member welded to said main body so as to have a welding seam on at least one of said lateral surfaces;

said base member having an edge with a continuous circumferential groove for receiving and guiding the saw chain;

said separate front member having a base surface and said main body having an end face;

said base surface abutting said end face and defining a parting line therebetween;

said parting line covered by said welding seam connecting said main body and said separate front member;

said welding seam extending over substantially the entire length of said parting line;

wherein said end face has a plurality of recesses opening in a direction toward said base surface and wherein said base surface has a plurality of projections matching and engaging said recesses such that said end face and said base surface have a wave-shaped contour;

wherein said recesses and said projections are arranged on a circular arc described about a center point of said separate front member.

7. A guide bar according to claim 1, wherein said base surface is comprised of planar sections extending outwardly from said longitudinal central axis at an angle to one another.

8. A guide bar according to claim 7, wherein said angle opens-toward said separate front member and is approximately 100°.

9. A guide bar according to claim 1, wherein said welding seam is made by laser welding.

10. A guide bar according to claim 1, wherein said separate front member has a center point positioned on said longitudinal central axis, wherein a length of said separate front member in a direction of said longitudinal central axis is substantially identical to a height of said separate front member in a direction perpendicular to said longitudinal central axis, wherein said separate front member is symmetrical relative to said longitudinal central axis.

11. A guide bar according to claim 1, wherein said separate front member is symmetrical relative to said longitudinal central axis.

12. A guide bar according to claim 1, wherein said separate front member and said main body engage positive-lockingly perpendicularly to said longitudinal central axis in a plane of said base member defined by said lateral surfaces.

13. A guide bar according to claim 1, wherein said separate front member and said main body engage positive-lockingly in a direction of said longitudinal central axis.

14. A guide bar according to claim 1, wherein said separate front member comprises said entire deflection area.

15. A guide bar according to claim 1, wherein said separate front member is comprised of at least one side plate having an outer plate surface forming part of said outer lateral surfaces.

16. A guide bar according to claim 15, comprising two of said side plates extending parallel to one another.

17. A guide bar according to claim 16, wherein said side plates have a common base connecting said side plates at one side thereof to a U-shaped structure.

18. A guide bar according to claim 16, wherein said side plates comprise an overlap portion overlapping an edge of said end face of said main body in a direction of said longitudinal central axis, said overlap portion having an edge projecting from said lateral surface, wherein said welding seam is positioned along said edge on said outer lateral surfaces.

19. A guide bar for a saw chain, said guide bar comprised of:

a sword-shaped base member made of solid material and having a front end with a deflection area for a saw chain and a rear end for connecting said guide bar to a drive unit;

said base member having outer lateral surfaces extending from said front end to said rear end and having a longitudinal central axis extending from said front end to said rear end;

said base member comprised of a main body and a separate front member welded to said main body so as to have a welding seam on at least one of said lateral surfaces;

said base member having an edge with a continuous circumferential groove for receiving and guiding the saw chain;

wherein said separate front member is comprised of at least one side plate having an outer plate surface forming part of said outer lateral surfaces;

wherein said separate front member has a base surface and said main body has an end face, said base surface abutting said end face and defining a parting line therebetween, said guide bar further comprising a flat strip placed onto said parting line between said side plates and said main body for covering said parting line, said flat strip welded onto said outer lateral surfaces such that said welding seam extends on said outer lateral surfaces on said main body and on said outer plate surfaces of said side plates.

20. A guide bar according to claim 19, wherein said end face has a central stay projecting into a space between said side plates, said side plates welded to said central stay.

21. A guide bar according to claim 20, wherein said central stay extends along the length of said end face from a bottom of said circumferential groove on one longitudinal side of said guide bar to a bottom of said circumferential groove on the opposite longitudinal side of said guide bar.

22. A guide bar according to claim 1, further comprising a deflection sprocket wheel for the saw chain, said sprocket wheel rotatably supported at said separate front member.

23. A guide bar according to claim 1, wherein said separate front member is comprised of a harder material than said main body.

* * * * *